United States Patent [19]

Saunders et al.

[11] Patent Number: 5,000,266

[45] Date of Patent: Mar. 19, 1991

[54] HYDRAULIC/TORSION PACKOFF INSTALLATION TOOL

[75] Inventors: Brian Saunders, Chipping Sodbury, England; Jerry D. Smith, Houston, Tex.

[73] Assignee: Cooper Industries, Inc., Houston, Tex.

[21] Appl. No.: 518,980

[22] Filed: May 4, 1990

[30] Foreign Application Priority Data

Oct. 6, 1989 [EP] European Pat. Off. ..... 89310254

[51] Int. Cl.[5] ..... E21B 33/04; E21B 23/00

[52] U.S. Cl. ..... 166/387; 166/136; 166/182; 166/208

[58] Field of Search ..... 166/387, 123, 181, 182, 166/208, 214, 215, 136, 137

[56] References Cited

U.S. PATENT DOCUMENTS

| | | | |
|---|---|---|---|
| 2,998,072 | 8/1961 | Crowe | 166/123 |
| 3,350,130 | 10/1967 | Ahlstone et al. | 294/86.25 |
| 3,357,486 | 12/1967 | Brown | 166/0.6 |
| 3,543,847 | 12/1970 | Haeber | 166/0.6 |
| 3,871,449 | 3/1975 | Ahlstone | 166/208 X |
| 3,897,823 | 8/1975 | Ahlstone | 166/120 |
| 4,003,434 | 1/1977 | Garrett et al. | 166/136 X |
| 4,019,580 | 4/1977 | Garrett | 166/387 |
| 4,597,448 | 7/1986 | Bangl | 166/387 X |

*Primary Examiner*—Hoang C. Dang

*Attorney, Agent, or Firm*—Jackie Lee Duke

[57] ABSTRACT

An improved wellhead annulus seal installation tool and preload retention apparatus is disclosed particularly adapted for metal-to-metal seals. The seal installation tool includes a telescoping mandrel with a torsion spring attached and a torque sleeve rotatably mounted thereon with a pair of antirotation pins for limiting the rotation of the torque sleeve, a resilient seal for sealing the lower portion of the tool inside the hanger and torque pins for transmitting the torque and axial movement of the tool to the preload retention apparatus. The preload retention apparatus includes an upper body with an annulus packoff seal which may be resilient or metal-to-metal and a driving ring threaded thereon. An expansible lock ring in carried on the driving ring with an expander ring thereabove which coacts with the seal installation tool to thereby lock the annulus packoff seal inside the wellhead.

8 Claims, 13 Drawing Sheets

HYDRAULIC/TORSION PACKOFF INSTALLATION TOOL

BACKGROUND

The increased use of metal-to-metal sealing means for wellhead annulus seals has created a need for means for generating the large compressive loads needed typically to energize these seals. Additionally, the problem exists of how to retain this large compressive load in the seal after the load generating means has been removed. A possible solution would require that the drill pipe used to lower the sealing means into position be rotated while pressure was being applied in the annular region between the sealing means and the rams of the blowout preventer. Such rotation of the drill pipe while the pipe rams of the blowout preventer are closed and subjected to pressure is considered highly unacceptable by some operators.

Alternatively, in an effort to avoid rotating the drill pipe with the pipe rams closed, some prior inventions have employed various complex hydraulic or mechanical means to allow compression and locking of the sealing means. These devices have had various shortcomings such as requiring excessive drill pipe rotation, requiring precise location of the tool within the wellhead housing, or lacking sufficient capacity to generate the force required to activate the seal.

This invention is for an improved seal installation tool and lockdown mechanism that generates a sufficiently large load for setting metal-to-metal wellhead annulus seals. It does not require the rotation of drill pipe while the rams of the blowout preventer are under pressure. The lockdown mechanism locks the preload into the seal as the seal is energized. The invention is particularly suited for use with metal-to-metal seals requiring high compressive loads for setting.

Prior packoff installation tools and lockdown mechanisms included the torque type mechanism disclosed in the A.G. Ahlstone et al. U.S. Pat. No. 3,350,130. The Ahlstone installation tool structure allows the seal assembly to be lowered to the wellhead and tightened by rotation of the drill pipe prior to testing.

The C.C. Brown U.S. Pat. No. 3,357,486 discloses another seal setting structure which allows for either mechanical or hydraulic actuation of the seal assembly. The Brown invention requires the seal setting structure to be aligned with a groove in the wellhead housing for proper orientation and operation.

The J.A. Haeber U.S. Pat. No. 3,543,847 discloses a seal installation tool which uses the weight of the drill string to initially set the seal and BOP test pressure to apply additional actuation load and activate a lockdown mechanism into an annular groove in the wellhead housing interior.

The A.G. Ahlstone U.S. Pat. No. 3,897,823 discloses a similar structure which utilizes a combination of drill string weight and hydraulic force to set the seal and uses a wedge-type lock against the interior wall of the wellhead housing.

SUMMARY

The subject invention pertains to a wellhead annulus seal installation tool and the lockdown mechanism used to retain the preload introduced into the seal. The tool can be used with elastomeric or metal-to-metal seals. The installation tool includes a central tubular member with a drill pipe upper connection and an enlarged lower cylindrical member with radially mounted pins for engaging and tightening the seal assembly. A large torsion spring surrounds the central tubular member, restrained by end plates. The central tubular member is keyed to the lower cylindrical member to transmit torque.

The seal lockdown mechanism utilizes a beveled split ring in combination with a pair of telescoping cylinders, the innermost threadedly engaged to the packoff. "Z"-slots on the outside of the outer cylinder are engaged by the aforementioned pins for tightening the packoff.

An object of the present invention is to provide an improved packoff installation tool that generates a high setting load without requiring excessive tightening torque being transmitted through drill pipe.

Another object of the present invention is to provide an improved packoff installation tool that allows the preload generated in the seal during the seal setting operation to be locked in while the load is being applied.

A further object of the present invention is to provide a seal lockdown mechanism which combines ease of operation and does not require precise location of the lockdown ring with respect to the wellhead.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1A:
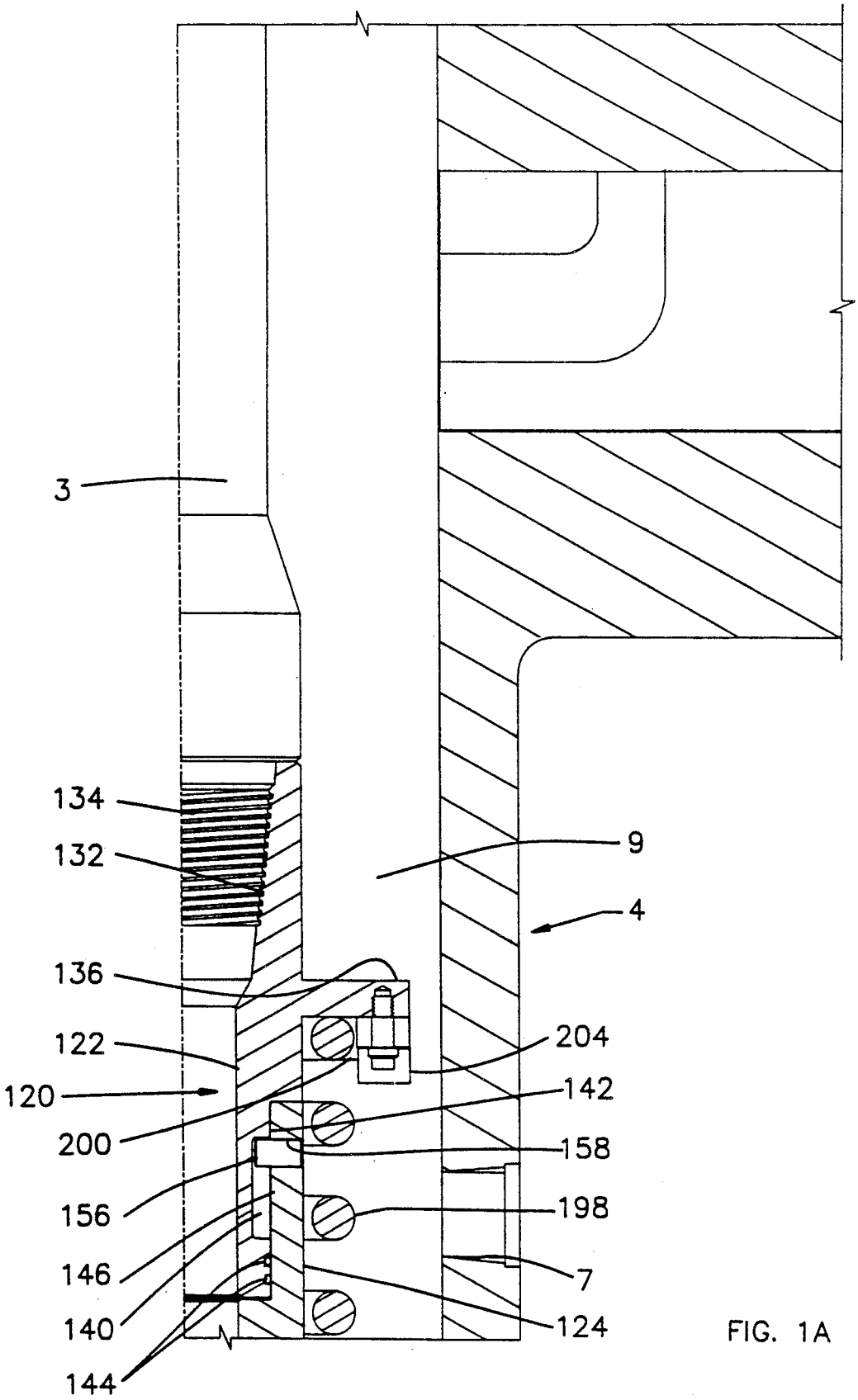
FIGS. 1A and 1B are quarter sectional views of a wellhead and blowout preventer assembly with the improved sealing means installation tool and metal-to-metal sealing means being lowered therein with FIG. 1A being the upper portion and FIG. 1B being the lower portion thereof.
Figure 1B:
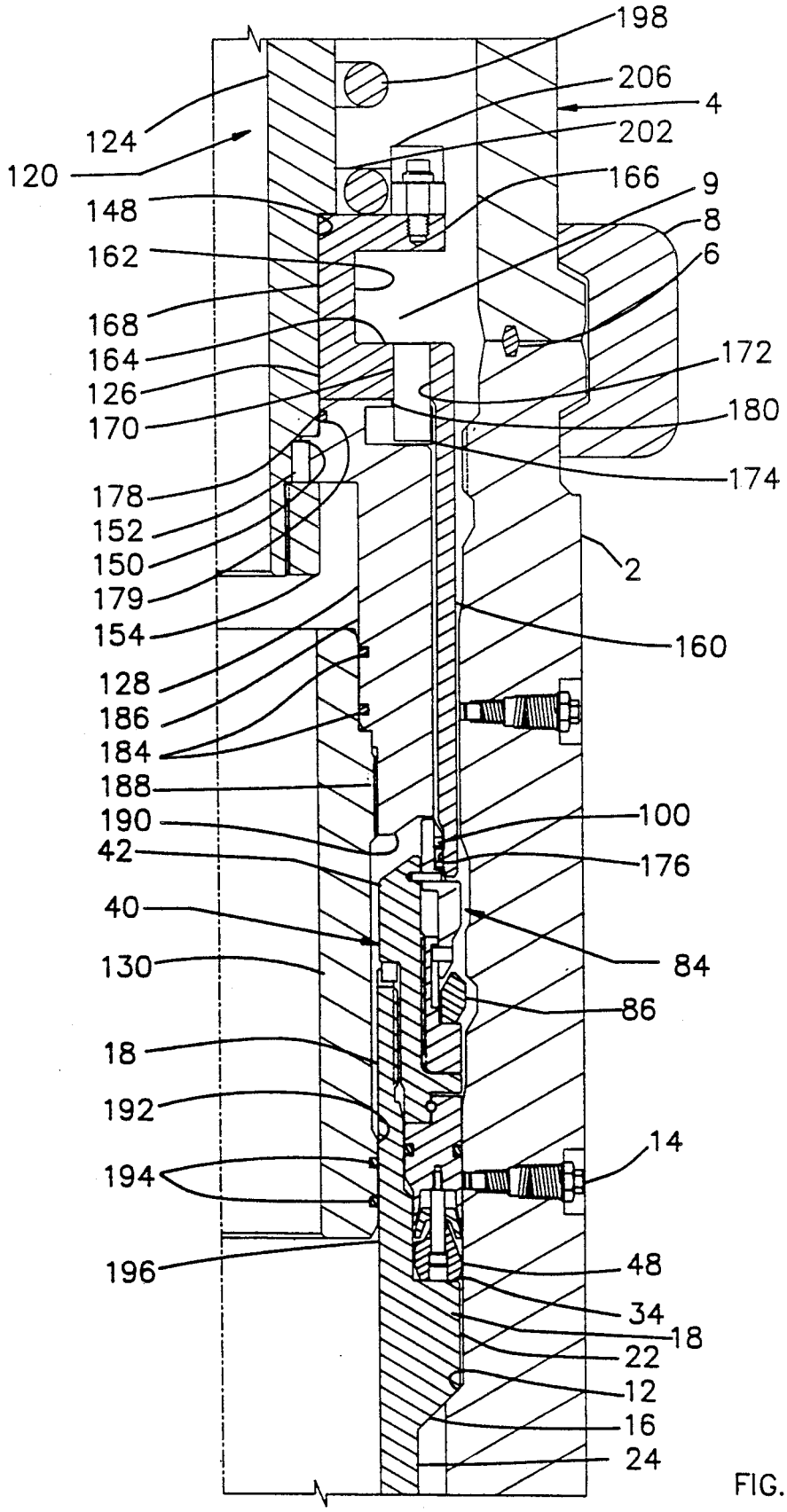

With reference to FIGS. 1A and 1B, retention means 8 clamps wellhead housing 2 and blowout preventer 4 together in sealing engagement, with seal ring 6 therebetween. Suitable porting means 7 of blowout preventer 4 allows pressurization of annulus 9 for purposes to be explained hereinafter. The lower end of housing 2 has upwardly facing shoulder 12 located on the inside of the housing. Test port 14 is located axially above shoulder 12 and allows monitoring of annulus pressure. Inside housing 2, and sitting on shoulder 12 is downwardly and outwardly facing external shoulder 16 on the outside, lower portion of casing hanger 18.

Figure 1C:
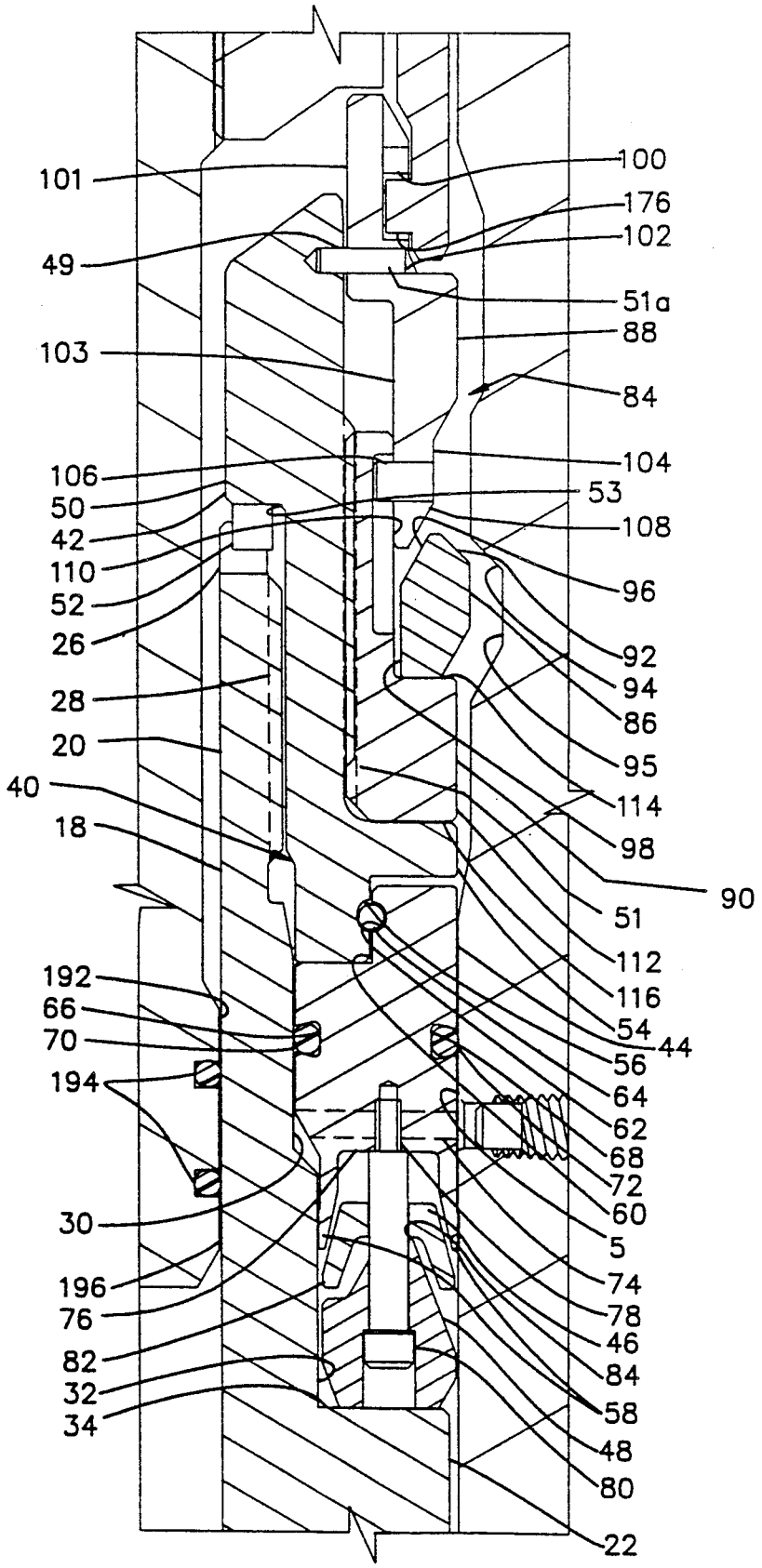
FIG. 1C is an enlarged sectional view of the seal lockdown mechanism and metal-to-metal sealing means initially landed in the annulus between the hanger and wellhead.

Referring to FIG. 1C, it can be seen that casing hanger 18 is a generally tubular member with reduced upper portion 20, thicker middle portion 22, and reduced lower portion 24 with downwardly facing shoulder 16 located therebetween. Upper portion 20 has a pair of radial slots 26 on its upper face for engagement with the packoff in a manner to be described later. Upper portion 20 has external threads 28 for lowering hanger 18 into position. Displaced axially therebelow is external seal surface 30 with seal surface 32, of a slightly larger diameter, axially below surface 30. Thicker middle portion 22 is joined to upper portion 20 by upwardly facing shoulder 34. Downwardly and outwardly facing external shoulder 16, axially below shoulder 34, connects middle portion 22 with lower portion 24. Lower portion 24 is internally threaded at its lower end and receives a casing (not shown).

Packoff assembly 40 consists of upper body 42, metal seal ring 44, activator ring 46, and lower body 48. Upper body 42 is generally cylindrically shaped with an inwardly facing annular flange 50 at its upper end and has thread 51 disposed thereon. Radial holes 49, disposed above thread 51, receive shearable members **51*a* for purposes to be described later. Spring loaded antirotation pins 52 disposed on lower face 53 of flange 50 and engage slots 26 of casing hanger 18 in a manner to be described hereinafter. The lower portion of upper body 42 has radially outwardly extending annular flange 54 with external groove 56** therebelow.

Metal seal ring 44 is a cylindrical member with a pair of downwardly depending seal lips 58 at its lower end. The upper end of metal seal ring 44 has a reduced portion 60 with groove 62 disposed thereon, and opposite to groove external 56 of upper body 42. A circular cross-section retention ring 64 engages grooves 56 and 62 to connect upper body 42 and seal ring 44. Seal grooves 66 and 68 are disposed on the interior and exterior, respectively, of the middle portion of seal ring 44, with seal rings 70 and 72 disposed therein respectively. Radially drilled hole 74 is located below seal grooves 66 and 68 and above seal lips 58 to provide fluid communication between the interior and exterior of seal ring 44. Between seal lips 58 is counterbore 76 with equally spaced longitudinally tapped holes 78 into which socket head shoulder screws 80 are threaded. Shoulder screws 80 retain activator ring 46 and lower body 48 on seal ring 44.

Activator ring 46 is an annular ring with an inverted "U" cross section. Legs 82 of activator ring 46 depend outwardly and downwardly to provide wedging surfaces for activation of seal lips 58 in a manner to be described hereinafter. Lower body 48 rests on shoulder 34 and supports activator ring 46 in spaced relationship thereto. Body 48 is a rectangular cross section ring with exterior sides converging upwardly to a top face 84 upon which activator ring 46 rests.

Packoff lockdown mechanism 84 is comprised of lock ring 86, expander ring 88, and driving ring 90. Lock ring 86 is a split ring with upper exterior tapered surface 92 to allow engagement with mating tapered surface 94 of groove 95 of wellhead housing 2. The top face of ring 86 is connected to interior surface 98 by camming surface 96, tapering downwardly and inwardly. Located immediately above lock ring 86 is expander ring 88 of lockdown mechanism 84.

Expander ring 88 is a cylindrical member with a stepped diameter. "J" slots 100 are disposed on the exterior of the reduced upper portion 101. Axially displaced below "J" slots 100 are radial holes 102, receiving shearable members **51*a*. The enlarged lower portion 103 of ring 88 has exterior retainer surface 104 thereon which is connected to the lower face of ring 88 by exterior conical camming surface 108. Circumferentially disposed in lower portion 103 are pins 106 which are flush with surface 104 and extend through the enlarged lower portion 103 of ring 88 to engage "Z" shaped slots 110 on driving ring 90**.

Driving ring 90 is a tubular member with radially extending lower annular flange 112 having upwardly facing shoulder 114 and lower face 116. Immediately above flange 112 are previously noted "Z" slots 110 on the exterior of the upper portion of driving ring 90. Driving ring 90 is axially moveable on upper body 42 by threads 51.

Seal installation tool 120 consists of upper spring retainer 122, body 124, torque sleeve 126, reaction sleeve 128 and seal sleeve 130. Spring retainer 122 is a generally tubular member with upper threaded bore 132 sealingly receiving conventional drill pipe pin 134 and annular flange 136 disposed on the exterior thereof. Below flange 136 are circumferentially spaced longitudinal torque slots 140 located on lower reduced portion 142. Suitable sealing means, such as "O" rings 144, are disposed on reduced portion 142 below torque slots 140.

Body 124 is a generally cylindrical member with counterbore 146 on its upper end and extending axially downward and closely fitting about reduced portion 142 of spring retainer 122, with sealing means 144 sealing thereon. The lower exterior of body 124 is stepped with first reduced portion 148 slidingly receiving torque sleeve 126. Reaction sleeve 128 is counterbored on its upper interior to closely fit on first reduced portion 148 and second reduced portion 150 of body 124 with suitable antirotation means, such as pins 152 interposed therebetween. Torque sleeve 126 and reaction sleeve 128 are retained on body 124 by suitable means such as threaded nut 154. Torque transmission means, such as pins 156, are press fit in radial holes 158 on the upper portion of body 124 which are in registry with torque slots 140. Pins 156 protrude into slots 140 and transmit torque from spring retainer 122 to body 124 for purposes to be explained hereinafter.

Torque sleeve 126 is a generally tubular member with lower outer cylindrical portion 160 connected to upper inner cylindrical portion 162 by radially extending flange 164. The upper end of cylindrical portion 162 is surmounted by radially extending flange 166. Inner surface 168 of inner portion 162 slidingly fits on first reduced portion 148 of body 124, allowing relative rotation therebetween. Antirotation pin 170 is press fit into vertical hole 172, disposed on the periphery of flange 164, and extends therebelow to engage pin 174, which is radially disposed on the upper periphery of reaction sleeve 128. Torque pins 176 are radially disposed on the lower interior of cylindrical portion 160 to allow engagement with "J" slots 100.

Reaction sleeve 128 is a generally tubular member with radially inwardly extending flange 178. The upper interior of flange 178 is counterbored as noted previously to fit a mating profile on the lower exterior of body 124 with sealing means such as O-ring 179 thereon. Reduced portion 18O on the upper exterior of sleeve 128 has reaction pin 174 disposed therein for coaction with antirotation pin 170. Sealing means, such as O-rings 184 are disposed on interior surface 186 of reaction sleeve 128 for sealing against seal sleeve 130. Threads 188 immediately therebelow connect reaction sleeve 128 and seal sleeve 130. Lower face 190 of reaction sleeve 128 has a profile for coaction with upper body 42 of seal assembly 40 as described hereinafter.

Seal sleeve 130 is a generally tubular member threadedly and sealingly engaged to reaction sleeve 128 as described above. Sleeve 130 extends downwardly into casing hanger 18 with enlarged lower portion 192 having suitable seal means such as O-rings 194, for sealing against bore 196 of casing hanger 18.

Spring 198 is a left-hand coil torsion spring closely fitting on upper spring retainer 122 and body 124, axially restrained by flange 136 and flange 166 of torque sleeve 126. End portions 200 and 202 extend radially outward with suitable retaining means 204 and 206 thereon allowing torsion therebetween. When installation tool 120 is assembled, an initial torsion is placed on spring 198 and clamping means 204 and 206 are installed to retain the torque induced in the spring.

A typical sequence of operations for the improved wellhead annulus seal installation tool and lockdown mechanism when utilized with a metal-to-metal seal would be as follows. Referring now to FIGS. 1A, 1B and 1C, casing hanger 18 has been landed and cemented in place in wellhead housing 2 with shoulder 16 sitting on shoulder 12 in a manner well known in the art. Seal assembly 40 is attached to installation tool 120 with torque pins 176 engaged in "J" slots 100. Pins 106 are engaged in the upper portion of "Z" shaped slot 110, thereby restraining expander ring 88 from axial movement during the lowering of seal assembly 40 and tool 120, while frangible members **51*a*, engaging holes 49 and 102, prevent rotation of expander ring 88 relative to upper body 42. Lock ring 86 is retracted, with interior surface 98 closely fitting on the upper portion of driving ring 90 whose lower face 116 contacts annular flange 54**.

Installation tool 120 with seal assembly 40 attached is lowered on drill pipe running string 3 into its initial position in the annulus between hanger 18 and wellhead housing 2. Downward movement is arrested when activator ring 46 and lower body 48 land on shoulder 34. In this initial position, metal seal lips 58 are in contact with seal surface 32 and seal bore 5. Concurrently, seal rings 70 and 72 contact seal surface 30 and seal bore 5 as spring loaded antirotation pins 52 contact the top face of hanger 18.

Figure 2A:
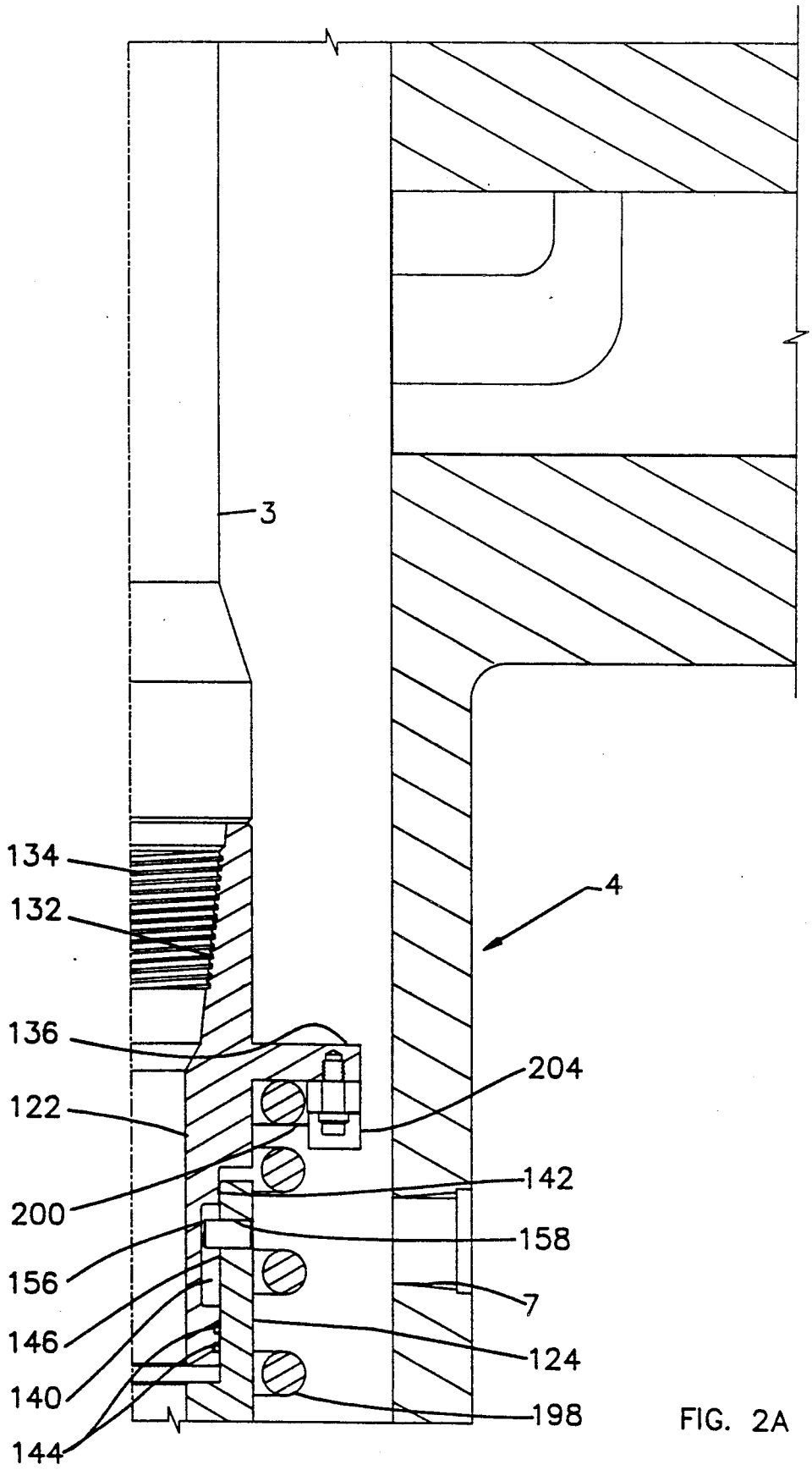
FIGS. 2A and 2B are quarter sectional views of the improved sealing means installation tool and metal-to-metal sealing means initially set by torque with FIG. 2A being the upper portion and FIG. 2B being the lower portion thereof.
Figure 2B:
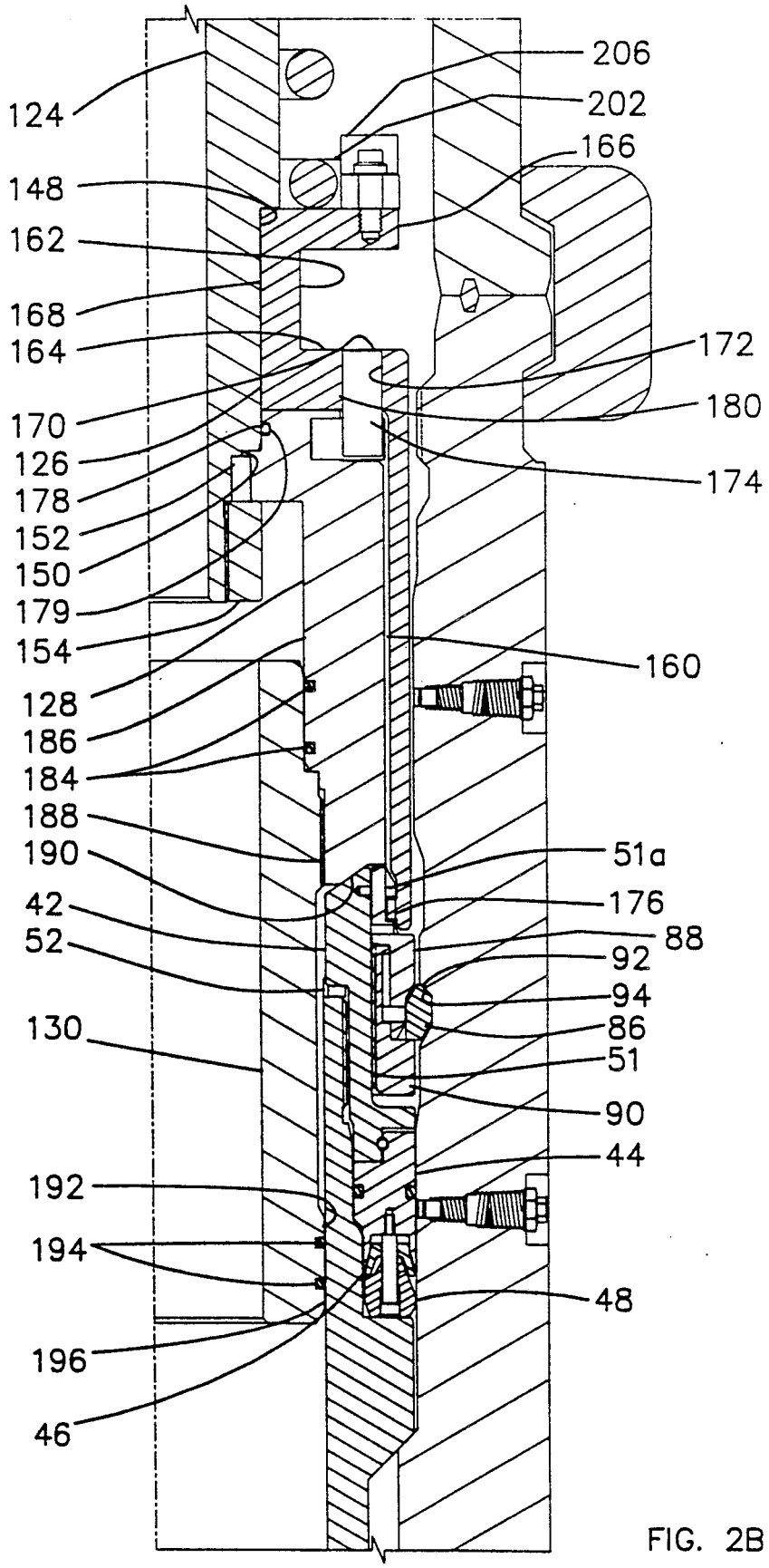

Initial mechanical preloading of metal seal lips 58 is accomplished in the following manner. Referring now to FIG. 2, right hand torque is applied to drill pipe running string 3 at the surface by conventional means well known in the art. This torque is transmitted through threaded connection 132 to upper spring retainer 122, through torque transmission means 156 to body 124, through pins 152 to reaction sleeve 128 and to seal sleeve 130 by threads 188. Simultaneously, torque is transmitted from retainer 122 to torque sleeve 126 by spring 198 and its retaining means 204 and 206. Torque sleeve 126 transmits this torque to expander ring 88 which shears members **51*a*. Engagement of antirotation pins 52 in slots 26 prevents upper body 42 from rotating as members 51*a* are sheared. This allows pins 106 to rotate into alignment with the axial portion of slot 110 and thereby translate ring 88 axially downward, camming lock ring 86 to its fully expanded position within groove 95. Further rotation moves pins 106 to the end of the lower portion of slot 110, out of alignment with the axial portion, thereby causing driving ring 90 to rotate and move vertically upward until shoulder 114 contacts the lower face of lock ring 86**.

The engagement of antirotation pins 52 in slots 26 prevents upper body 42 from rotating when driving ring 90 is rotating. Driving ring 90 moves upward until surfaces 92 and 94 contact. Further rotation of ring 90 causes a downward load on seal lips 58 from the coaction of threads 51 on upper body 42, seal ring 44 and activator ring 46.

As the applied torque reaches the level initially set in spring 198 during assembly, upper portion 200 rotates clockwise with respect to lower portion 202 thereby storing torsional energy in spring 198. This rotation causes pin 174 on reaction sleeve 128 to move clockwise up to a maximum of one revolution when it contacts pin 170.

Figure 3A:
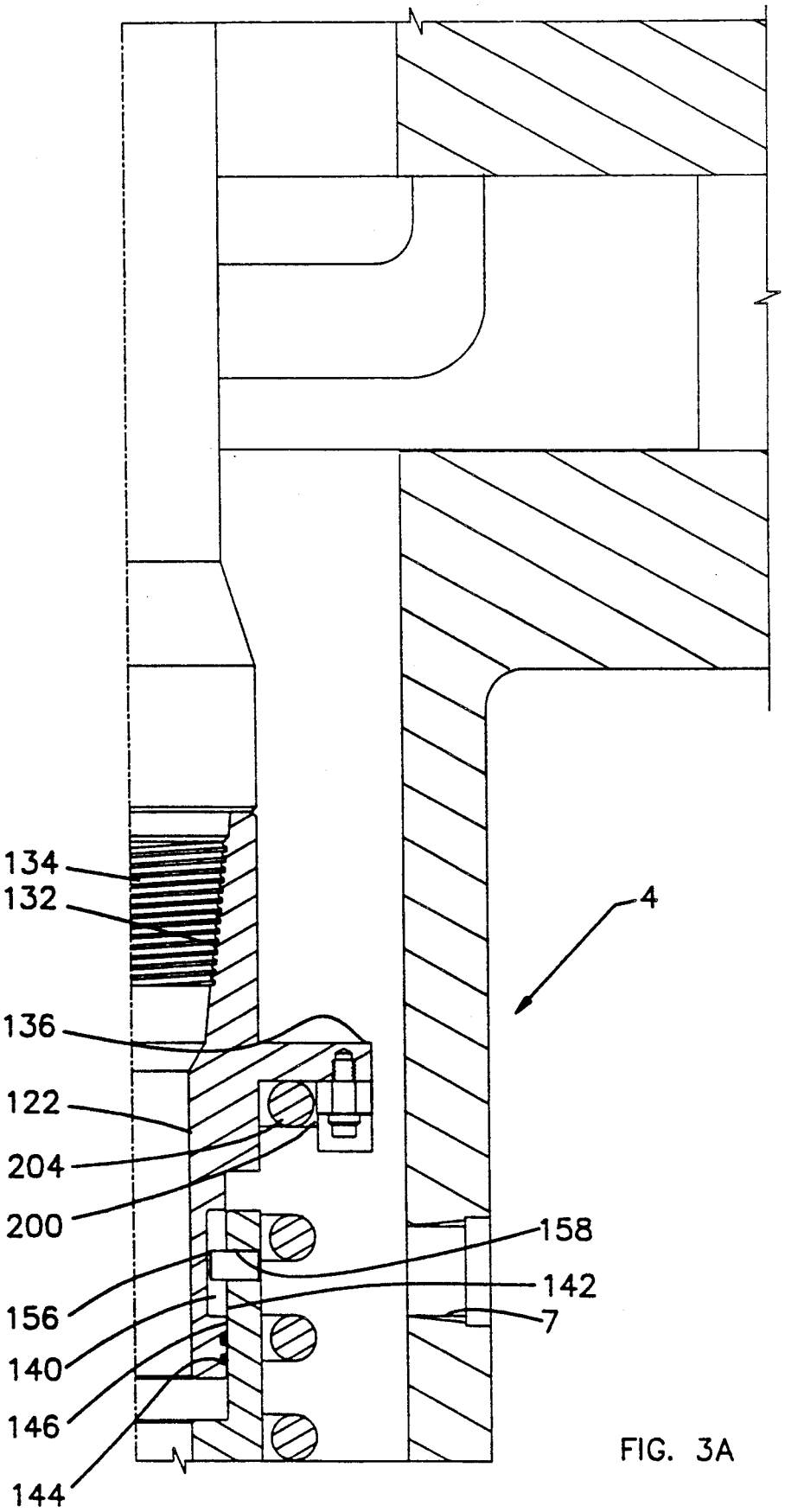
FIGS. 3A and 3B are quarter sectional views of the improved sealing means installation tool and metal-to-metal sealing means completely set and locked in place with FIG. 3A being the upper portion and FIG. 3B being the lower portion thereof.
Figure 3B:
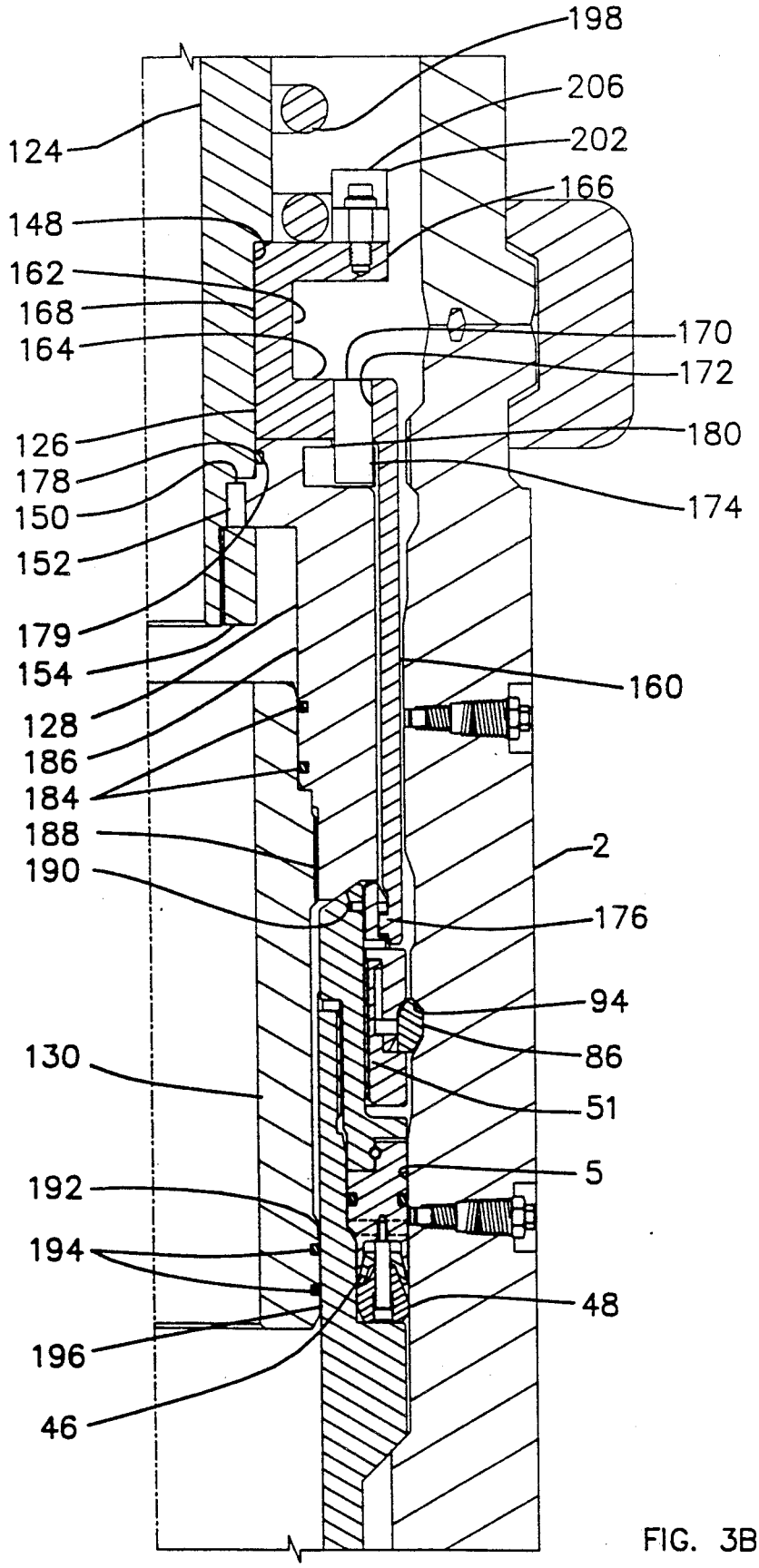

Improved seal installation tool 120 is now used to hydraulically load the seal. Referring now to FIGS. 3A and 3B, with the desired torque applied, blowout preventer rams are closed on drill pipe 3, and pressure applied to the annulus between tool 120 and wellhead 2, above packoff assembly 40. The pressure applied acts on the annular area defined by seal surfaces 186, 196 and 5 to force sealing lips 58 into tighter engagement with seal bores 5 and 32 and activator ring 46, with surface 190 bearing on the upper face of upper body 42.

The closing of blowout preventer rams prevents rotation of drill pipe 3, upper spring retainer 122, body 124, reaction sleeve 128 and seal sleeve 130 while torque sleeve 126 can rotate due to the urging of spring 198. As setting pressure is applied through port 7, body 124, torque sleeve 126, reaction sleeve 128 and seal sleeve 130 are urged downward, further compressing seal lips 58 and disengaging lock ring 86 from tapered surface 94. The load on threads 51 is thus relieved allowing spring 198 to unwind, thereby urging torque sleeve 126 to rotate. This rotation is transmitted to threads 51 through the coaction of torque pins 176 in "J" slots 100 and pins 106 in slot 110. Ring 90 then rises, contacting lock ring 86 and urging surfaces 92 and 94 into reengagement. Setting pressure is then released and BOP rams are opened. Test pressure is applied through suitable porting means, such as test port 14 to verify seal integrity. If the test is unsuccessful, the preceding steps can be repeated to further compress packoff assembly 40.

Alternatively, packoff assembly 40 can be retrieved by rotating pins 106 of expander ring 88 into alignment with the vertical portion of slot 110 and lifting thereby allowing lock ring 86 to retract. Packoff 40 and tool 120 can then be retrieved to the surface. If the seal integrity test is successful, pins 176 are disengaged from "J" slot 100 and tool 120 is retrieved to the surface.

Figure 5A:
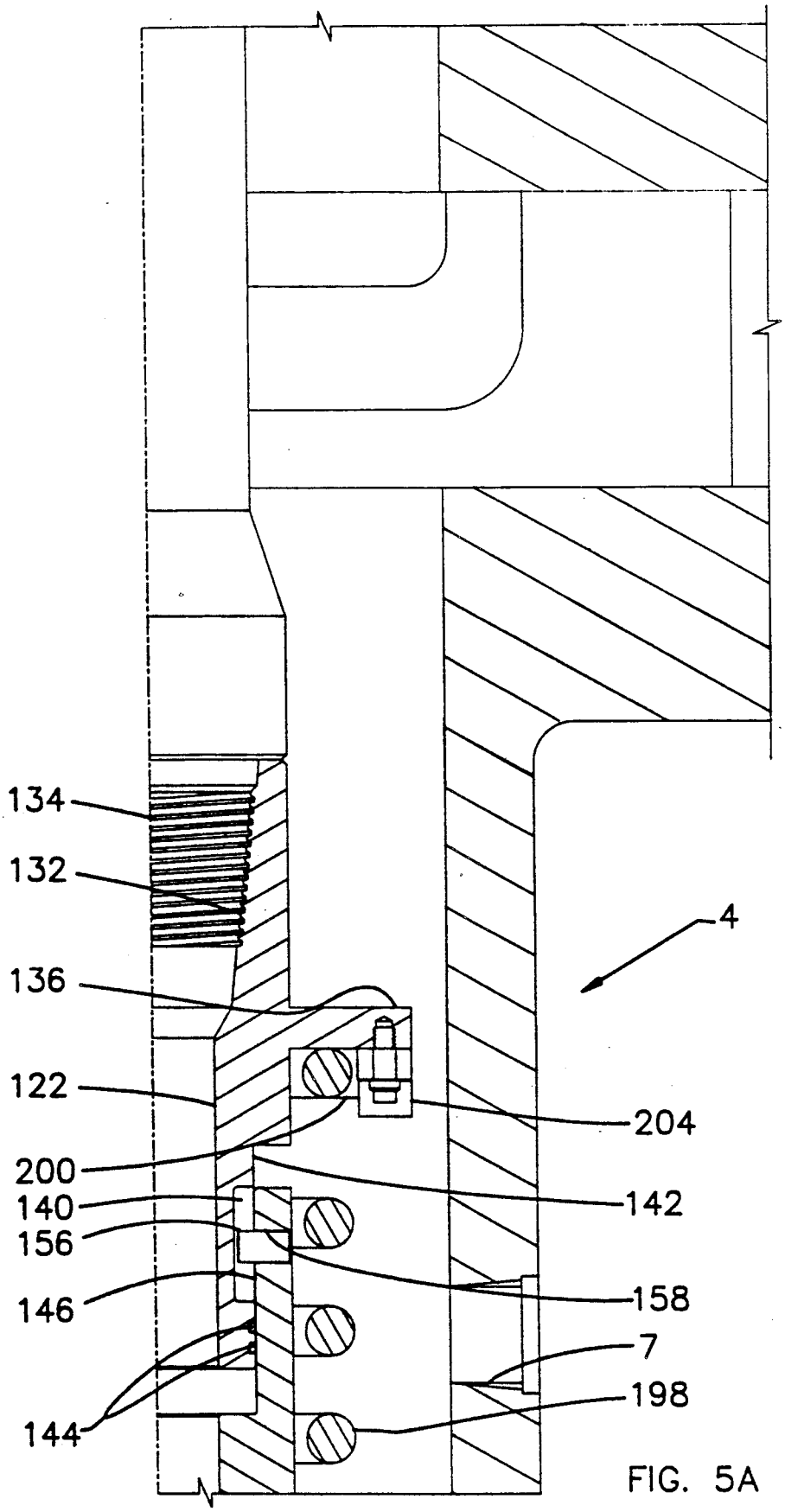
FIGS. 5A and 5B are quarter sectional views of the alternate emnbodiment with the resilient sealing means completely set and prior to engaging the lockdown mechanism with FIG. 5A being the upper portion and FIG. 5B being the lower portion thereof.
Figure 5B:
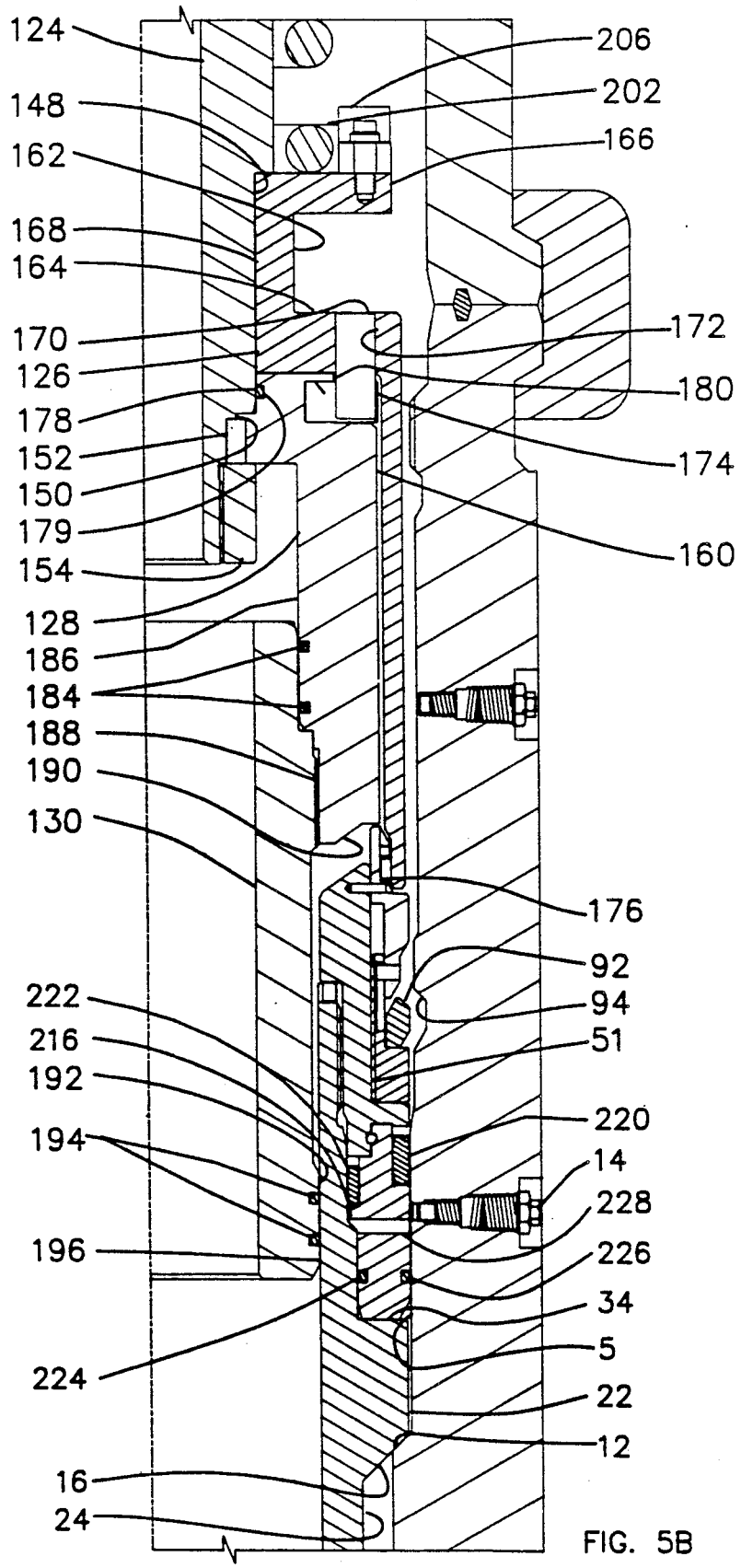
Figure 6A:
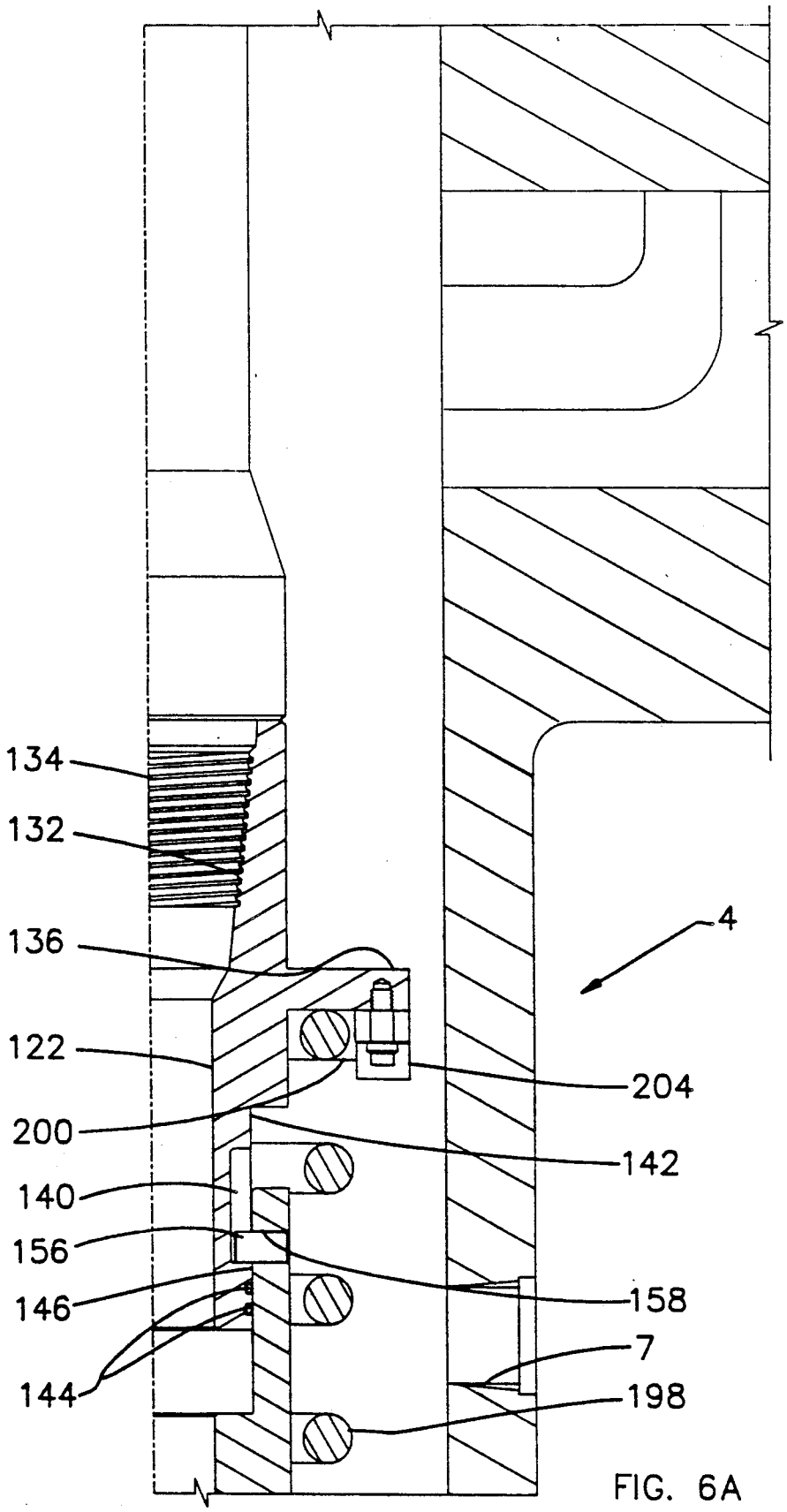
FIGS. 6A and 6B are quarter sectional views of the alternate embodiment with the lockdown mechanism fully engaged and the installation tool being retrieved with FIG. 6A being the upper portion and FIG. 6B being the lower portion thereof.
Figure 6B:
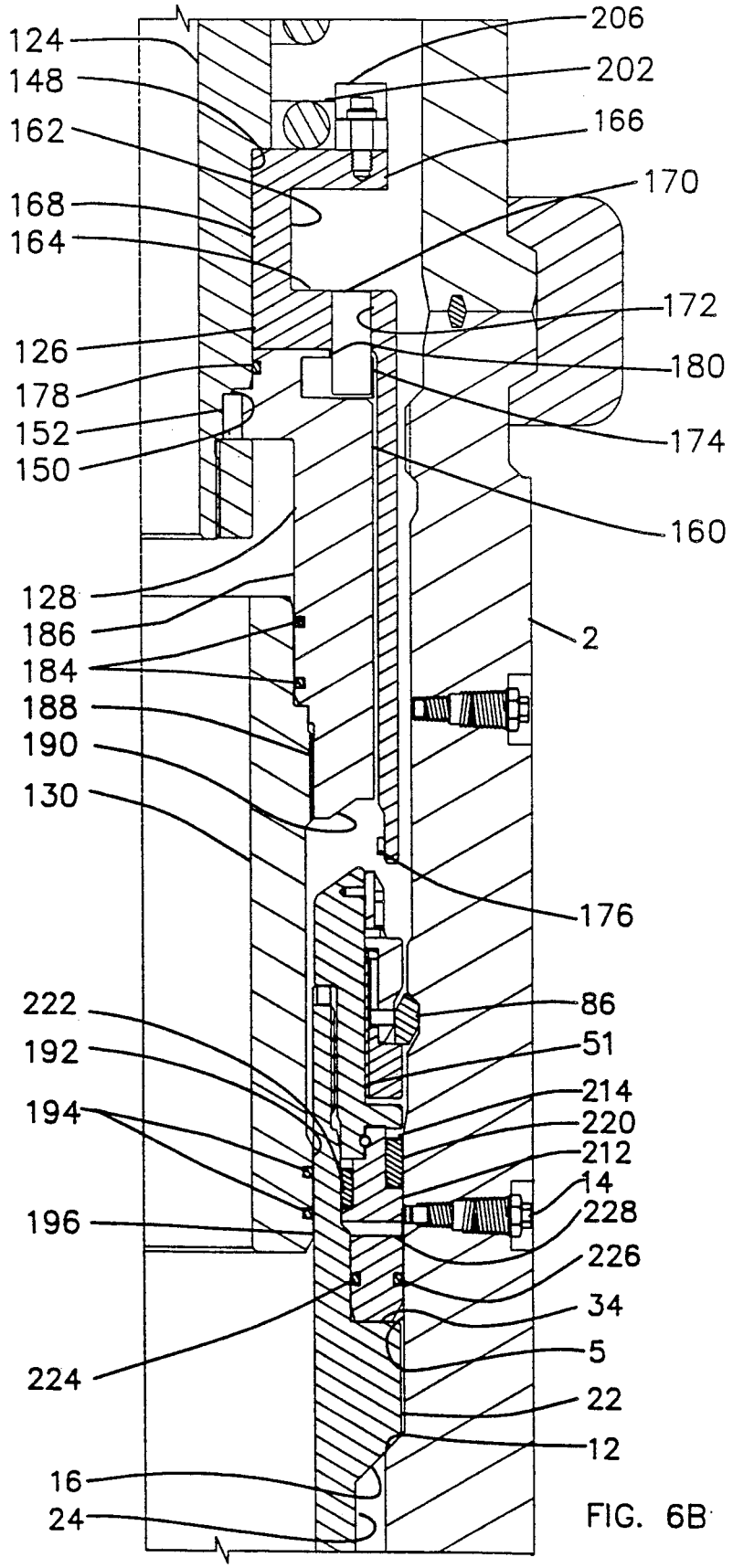

An alternate embodiment of the improved wellhead annulus seal installation tool and lockdown mechanism utilizing a resilient sealing means is depicted in FIGS. 4–6. Those items which are unchanged from the preferred embodiment retain the same numeral designation. This alternate embodiment differs from the preferred embodiment only in the substitution of resilient seal means, denoted generally by numeral 210, for metal-to-metal seal means 40. Resilient seal means 210 consists of upper body 42 and lower body 212. Lower body 212 is a generally cylindrical member with upstanding rim portion 214, middle portion 216 and reduced cross section lower portion 218. Sealing means 220 and 222 are located in stepped spaces on the outside and inside, respectively, of middle portion 216. Sealing means, such as O-rings 224 and 226 are located in suitable grooves on the inside and outside, respectively, of lower portion 218. Radial hole 228 is located between upper sealing means 220 and 222 and lower sealing means 224 and 226 for purposes to be explained hereinafter. Circular cross section retention ring 64 connects upper body 42 and lower body 212 as before. In all other respects, seal means 210 and tool 120 are identical to that of the preferred embodiment.

Figure 4A:
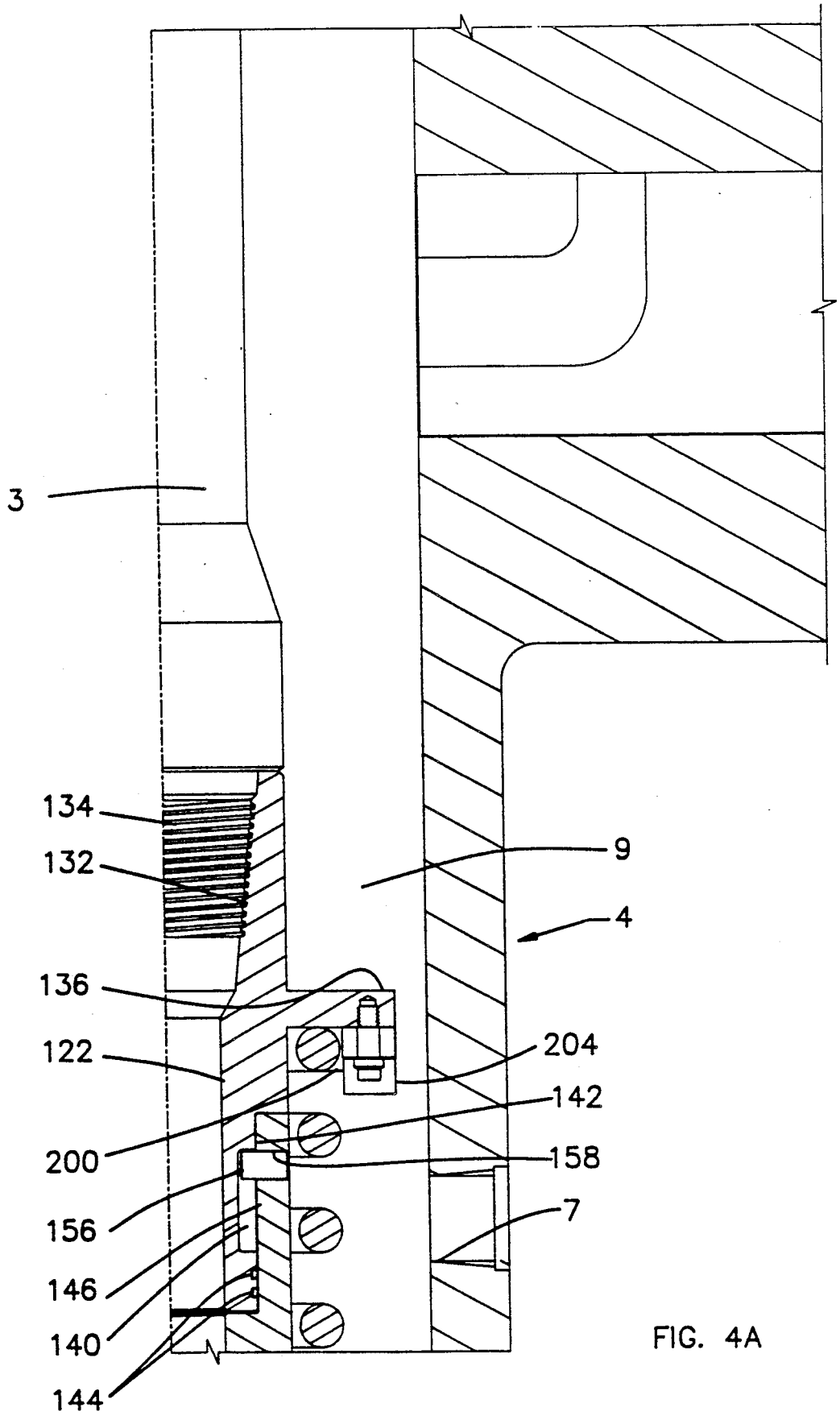
FIGS. 4A ans 4B are quarter sectional views of an alternate embodiment of the improved sealing means installation tool and a resilient sealing means initially landed in the annulus between the hanger and wellhead with FIG. 4A being the upper portion and FIG. 4B being the lower portion thereof.
Figure 4B:
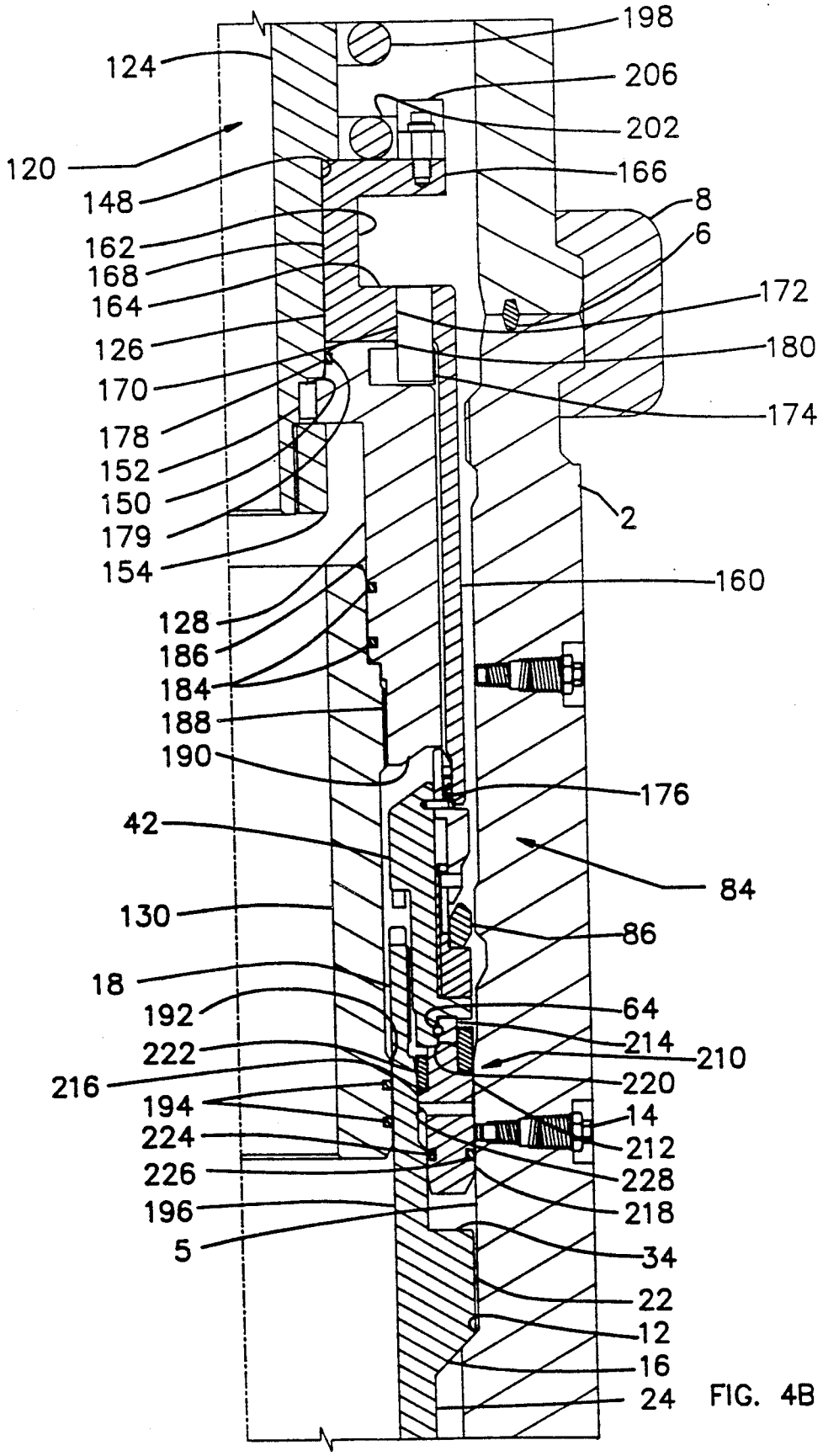

A typical sequence of operations for the alternate embodiment utilizing the elastomeric seal means would be as follows. Referring now to FIGS. 4A and 4B, casing hanger 18 has been landed in wellhead housing 2, with shoulder 16 sitting on shoulder 12, and cemented in place. Seal assembly 210 is attached to installation tool 120 by torque pins 176 engaging "J" slots 100, and is lowered on drill pipe running string 3 into the position shown in FIGS. 4A and 4B. At this point, sealing means 224 and 226 engage seal surface 32 and seal bore 5. Simultaneously, sealing means 222 and 220 are compressed slightly as they engage seal surface 32 and seal bore 5.

Referring now to FIGS. 5A and 5B, blowout preventer rams are closed on drill pipe string 3, and setting pressure applied through suitable porting means 7. This hydraulic pressure acts on the annulus defined by seal surfaces 196 and 146, causing tool 120 to stroke downward, with pins 156 guided in slots 140. Seal assembly 210 is thus forced downward to its fully set position, as best seen in FIGS. 5A and 5B.

With seal assembly 210 fully landed on shoulder 34 of hanger 18, tool 120 can be used to shear members 51*a*, and engage lock ring 86 in groove 95. Driving ring 90 is then raised as before, causing surfaces 92 and 94 to contact, thereby locking ring 86 in place. Test pressure is applied through suitable porting means such as test port 14 to verify seal integrity. Radially directed hole 228 allows test pressure to be communicated to seal means 220 and 222 to ensure proper seal verification. If the test is unsuccessful, the seal assembly 210 may be retrieved following the same steps as the preferred embodiment. If the seal integrity test is successful, pins 176 are disengaged from "J" slot 100 and tool 120 is retrieved to the surface as shown in FIG. 6.

What is claimed is:

1. A packoff installation and retention apparatus for a wellhead with a hanger positioned therein comprising:

a central telescoping tubular member with an upper portion and a lower portion connected for rotation therewith having sealing means therebetween, a first spring retention means on the exterior of said central telescoping tubular member, a torque sleeve rotatable on said lower portion with a second spring retention means on the upper face thereof, a torsion spring connected to said first and second spring retention means, a reaction sleeve sealingly mounted on said lower portion for rotation therewith having means for limiting rotation of said torque sleeve on said lower portion, a seal sleeve sealingly connected to said reaction sleeve with sealing means disposed on the exterior thereof, and an annulus seal retention means releasably connected to said torque sleeve for movement therewith having annulus sealing means therebelow.

2. A packoff installation and retention apparatus according to claim 1 wherein said exterior sealing means on said seal sleeve sealingly engages the bore of said hanger.

3. A packoff installation and retention apparatus according to claim 2 wherein said annulus seal retention means includes an upper body with a driving ring threadedly moveable thereon, an expansible lock ring adapted to engage an adjacent groove in said wellhead carried on said driving ring, and an expander ring coacting with said torque sleeve for selective movement of said expansible lock ring.

4. A packoff installation and retention apparatus according to claim 3 wherein said annulus sealing means includes a pair of downwardly diverging seal legs.

5. A packoff installation and retention apparatus according to claim 3 wherein said annulus sealing means is a resilient seal.

6. A packoff installation and retention apparatus according to claim 4 including an external upwardly facing shoulder on said hanger limiting the downward movement of said annulus sealing means.

7. A packoff installation and retention apparatus according to claim 5 including an external upwardly facing shoulder on said hanger limiting the downward movement of said annulus sealing means.

8. A method of generating and retaining preload in an annulus sealing means, which comprises:

lowering an annulus sealing and retention means into the annulus between a hanger and a wellhead with a seal installation means, rotating said seal installation means to generate an initial preload in said annulus sealing means and storing torsional energy in said seal installations means, sealing the annulus above said annulus sealing and retention means, pressurizing said annulus above said annulus sealing and retention means to increase said preload while simultaneously releasing said torsional energy to maintain said increased preload.

* * * * *